US011202143B2

(12) United States Patent
Sato

(10) Patent No.: US 11,202,143 B2
(45) Date of Patent: Dec. 14, 2021

(54) SOUND OUTPUT ASSEMBLY

(71) Applicant: YAMAHA CORPORATION, Hamamatsu (JP)

(72) Inventor: Akiyoshi Sato, Hamamatsu (JP)

(73) Assignee: YAMAHA CORPORATION, Hamamatsu (JP)

( * ) Notice: Subject to any disclaimer, the term of this patent is extended or adjusted under 35 U.S.C. 154(b) by 0 days.

(21) Appl. No.: 16/938,292

(22) Filed: Jul. 24, 2020

(65) Prior Publication Data

US 2020/0359128 A1 Nov. 12, 2020

Related U.S. Application Data

(63) Continuation of application No. PCT/JP2018/002657, filed on Jan. 29, 2018.

(51) Int. Cl.
*H04R 1/34* (2006.01)
*H04R 1/28* (2006.01)
*H04R 1/02* (2006.01)

(52) U.S. Cl.
CPC ..... *H04R 1/2873* (2013.01); *H04R 1/025* (2013.01); *H04R 2499/13* (2013.01)

(58) Field of Classification Search
CPC .. H04R 1/2869; H04R 1/2873; H04R 1/2876; H04R 1/288; H04R 1/2884; H04R 1/2888; H04R 1/2892; H04R 1/2896
See application file for complete search history.

(56) References Cited

U.S. PATENT DOCUMENTS 3,993,345 A * 11/1976 Croup ..... B60R 11/0217 296/37.16
5,640,461 A * 6/1997 Ebert ..... H04R 1/025 181/150
6,104,823 A 8/2000 Tanaka
6,578,658 B2 * 6/2003 Jones ..... B60R 11/0217 181/141

(Continued)

FOREIGN PATENT DOCUMENTS

JP S48080536 U 10/1973
JP H03098594 U 10/1991

(Continued)

OTHER PUBLICATIONS

International Search Report issued in Intl. Appln. No PCT/JP2018/002657 dated Apr. 17, 2018. English translation provided.

(Continued)

*Primary Examiner* — Ryan Robinson
(74) *Attorney, Agent, or Firm* — Rossi, Kimms & McDowell LLP

(57) ABSTRACT

A sound output assembly includes an enclosure, a speaker assembly disposed inside the enclosure, and a supporting member having at least a first end fixed to the enclosure such that the at least the first end of the supporting member and the enclosure are formed as one body. The speaker assembly includes an acoustic diaphragm configured to produce a sound by vibrating in accordance with a sound signal. The supporting member is configured to support the speaker assembly and to dampen vibration of the speaker assembly.

11 Claims, 7 Drawing Sheets

(56) References Cited

U.S. PATENT DOCUMENTS

| | | | | |
|---|---|---|---|---|
| 7,292,706 | B2 * | 11/2007 | Hamada | H04R 1/025 381/386 |
| 8,009,850 | B2 * | 8/2011 | Zhou | H04R 1/06 381/345 |
| 8,867,770 | B2 * | 10/2014 | Chien | H04R 1/2803 381/332 |
| 10,469,925 | B2 * | 11/2019 | Fukuhara | H04R 1/2896 |
| 2005/0194202 | A1 * | 9/2005 | Ito | B60R 11/0217 181/166 |
| 2009/0202095 | A1 * | 8/2009 | Yano | H04R 1/2819 381/349 |
| 2012/0128197 | A1 * | 5/2012 | Li | H04R 1/2896 381/395 |
| 2018/0139523 | A1 | 5/2018 | Takahashi | |
| 2020/0162809 | A1 * | 5/2020 | Honji | B60J 5/0463 |
| 2020/0221196 | A1 * | 7/2020 | Dong | H04R 1/026 |

FOREIGN PATENT DOCUMENTS

| | | | | |
|---|---|---|---|---|
| JP | H08223679 | A | 8/1996 | |
| JP | H10234091 | A | 9/1998 | |
| JP | 2001352591 | A * | 12/2001 | |
| JP | 2004289221 | A | 10/2004 | |
| WO | WO-2009144818 | A1 * | 12/2009 | H04R 1/288 |
| WO | 2017022254 | A1 | 2/2017 | |

OTHER PUBLICATIONS

Written Opinion issued in Intl. Appln. No. PCT/JP2018/002657 dated Apr. 17, 2018.

Office Action issued in Japanese Appln. No. 2019-567804 dated Jun. 22, 2021. English machine translation provided.

Office Action issued in Chinese Appln. No. 201880087187.X dated Jul. 21, 2021. Full English machine translation provided.

Office Action issued in Chinese Appln. No. 201880087233.6 dated Aug. 4, 2021. English machine translation provided.

* cited by examiner

SOUND OUTPUT ASSEMBLY

CROSS REFERENCE TO RELATED APPLICATION

This application is a Continuation Application of PCT Application No. PCT/JP2018/002657, filed Jan. 29, 2018, the entire contents of which are incorporated herein by reference.

BACKGROUND OF THE INVENTION

Field of the Invention

The present disclosure relates to the art of sound output assemblies.

Description of Related Art

There may be provided, in a car, for example, a sound output assembly that includes a speaker for output of sound. The sound output assembly is mounted to the interior of the car, and in accordance with a sound to be output processes an electrical signal for output of the sound.

In recent years, there has been developed a sound output assembly designed in an attempt to suppress vibrational noise resulting from transmission of vibration from the sound output assembly to the interior of the car. The sound output assembly includes an outer case and an inner case for housing a speaker, the inner case being provided within the outer case and a vibration absorber being interposed between the cases (see, for example, WO 2017/022254).

The conventional sound output assembly described is designed to suppress vibrational noise caused by transmission of vibration to the interior of a car. However, the conventional sound output assembly is subject to a drawback in that it is complex to build due to provision of the inner case within the outer case, which requires a large number of parts and incurs high cost.

SUMMARY

In view of the circumstances described above, the present disclosure has as its object provision of a sound output assembly that suppresses vibrational noise with use of fewer parts.

To achieve the stated object, a sound output assembly includes: an enclosure; a speaker assembly disposed inside the enclosure, and a supporting member having at least a first end fixed to the enclosure such that the at least the first end of the supporting member and the enclosure are formed as one body, in which the speaker assembly includes an acoustic diaphragm configured to produce a sound by vibrating in accordance with a sound signal, and the supporting member is configured to support the speaker assembly and to dampen vibration of the speaker assembly.

DESCRIPTION OF EMBODIMENTS

Figure 1:
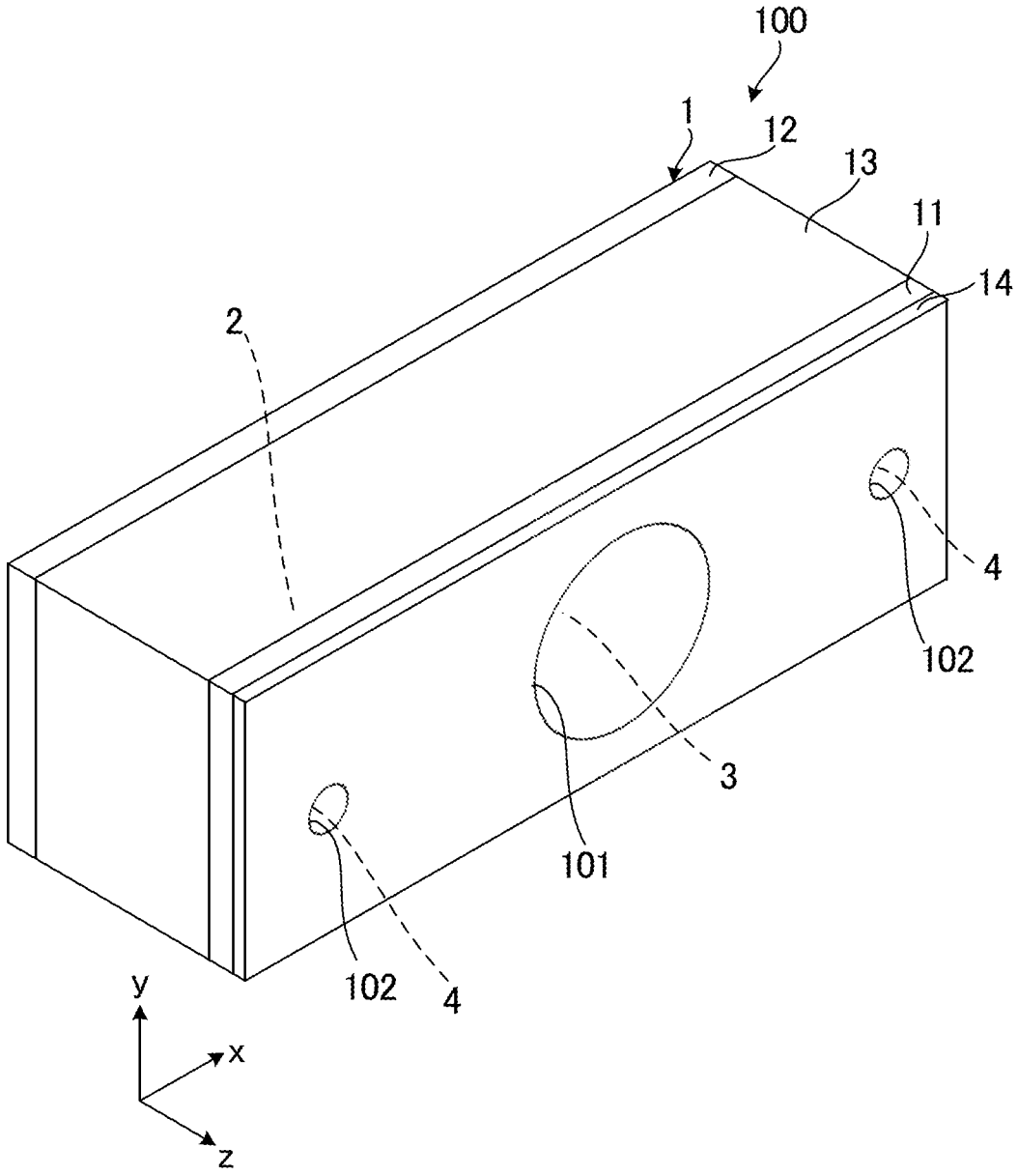
FIG. 1 is a schematic perspective diagram of a sound output assembly according to the first embodiment.

Embodiments of the present disclosure will be described below with reference to the drawings. It is of note that dimensions and scales of parts shown in the drawings may differ from those of actual products, as appropriate. In some of the drawings, select portions are depicted schematically for ease of understanding. The scope of the present disclosure is not limited to the following embodiments unless descriptions are included therein that particularly limit the present disclosure.

First Embodiment

Figure 2:
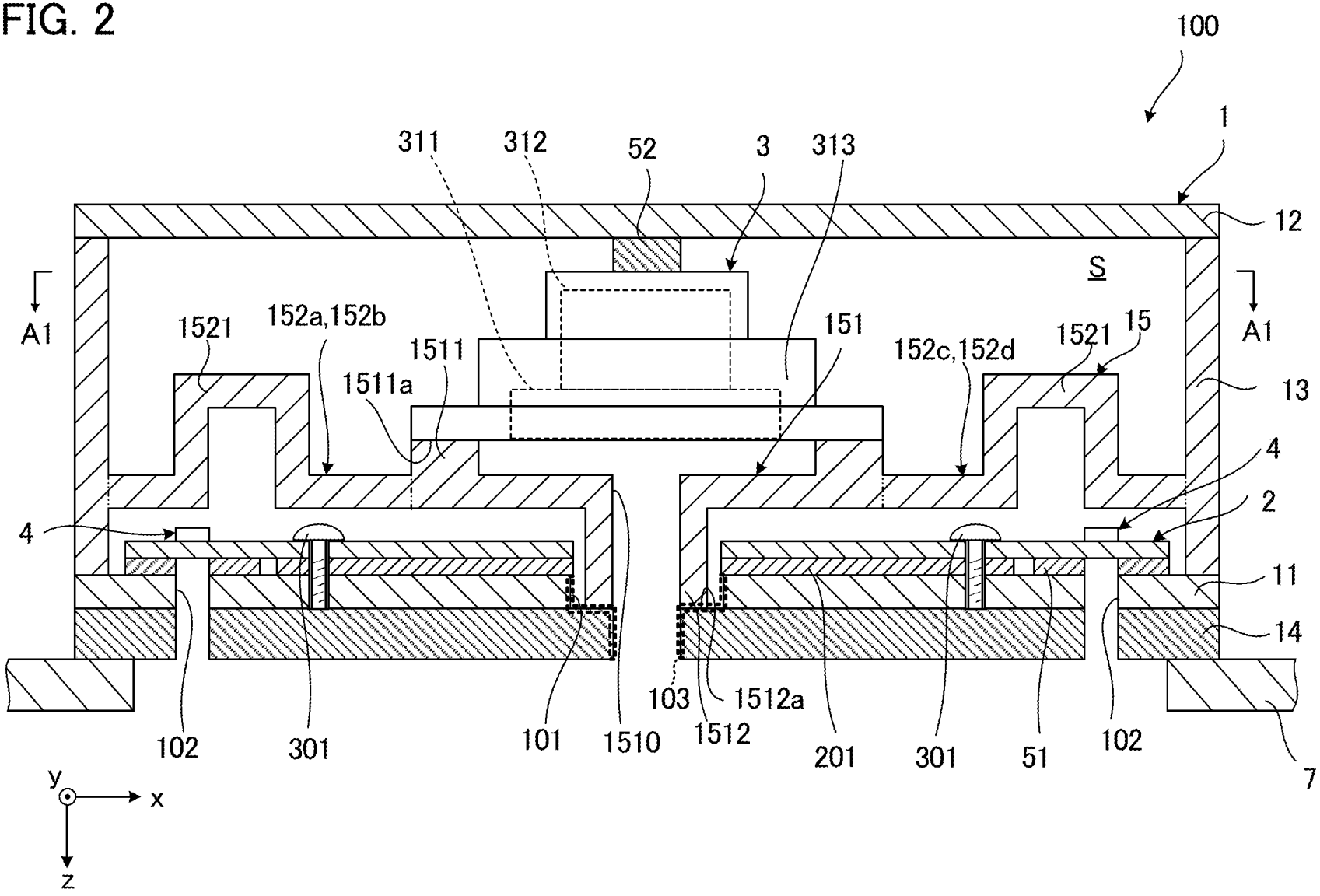
FIG. 2 is a cross-sectional view of the sound output assembly shown in FIG. 1.
Figure 3:
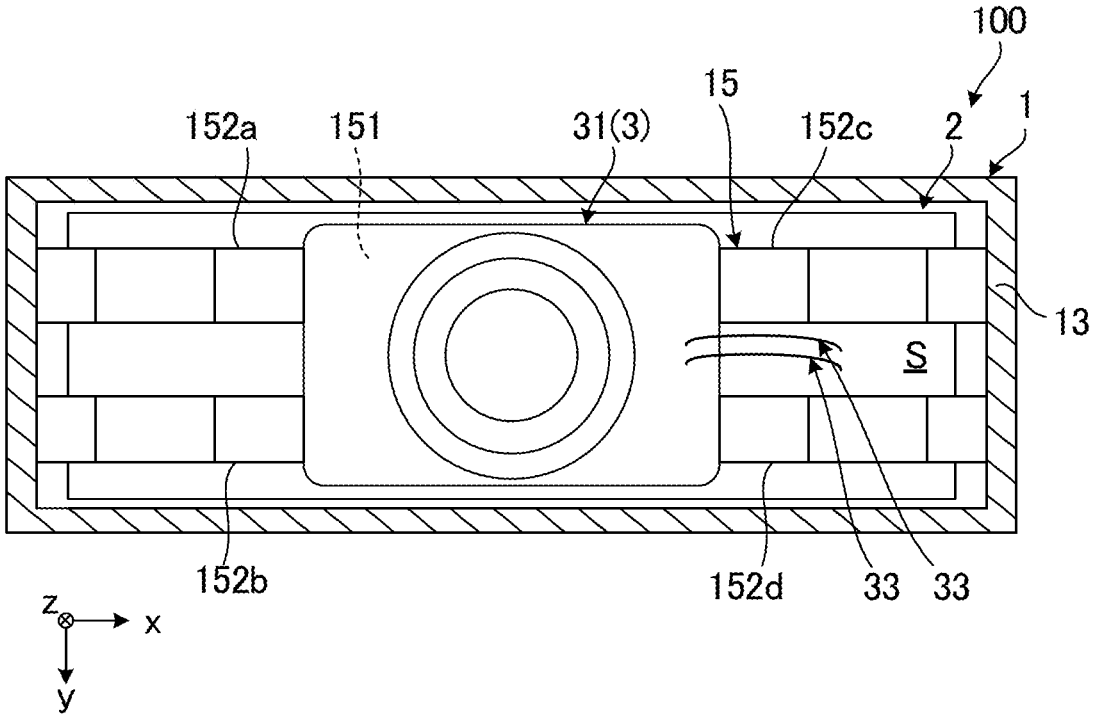
FIG. 3 a planar view of the inside of the sound output assembly shown in FIG. 1.

FIG. 1 is a schematic perspective diagram of a sound output assembly according to the first embodiment. FIG. 2 is a cross-sectional view of the sound output assembly shown in FIG. 1. FIG. 3 is a cross-sectional view taken along a line A1-A1 in FIG. 2, and shows in planar view the interior of the sound output assembly. For ease of understanding of arrangement of parts, in each of the drawings there are shown perpendicular to one another an x-axis, a y-axis and a z-axis.

As shown in FIGS. 1 and 2, a sound output assembly 100 includes an enclosure 1, a circuit board 2 that includes signal processing circuitry and is disposed inside the enclosure 1, and a speaker assembly 3. The speaker assembly 3 is disposed inside the enclosure 1 and outputs a sound in accordance with an electrical sound signal. As shown in FIG. 2, the sound output assembly 100 includes a supporting member 15 in addition to each of the enclosure 1, the circuit board 2 and the speaker assembly 3. The supporting member 15 is formed integral with the enclosure 1, and supports the speaker assembly 3 thereby to damp vibration of the speaker assembly 3. As used here, the description "the supporting member 15 is formed integral with the enclosure 1" does not include a case in which the supporting member 15 is attached to or detachable from the enclosure 1. The supporting member 15 and the enclosure 1 may be formed as a single body by welding, by molding, by bonding with adhesive, or by bonding with a double-sided adhesive tape.

The sound output assembly 100 further includes microphones 4 disposed inside the enclosure 1. Each of the microphones 4 converts a sound to a sound signal. The sound output assembly 100 can be described as "a sound input/output device." In FIG. 3, illustration of the microphones 4 is omitted.

The sound output assembly 100 may be used as a hands-free call device. The sound output assembly 100 is configured to communicate with a user's cell phone either by wireless or wired connection. The sound output assembly 100 receives a voice of the user via the microphones 4, and converts the received voice to a sound signal. The sound output assembly 100 also outputs a sound of a communicating person by use of the speaker assembly 3. For example, the sound output assembly 100 receives a sound signal of a voice of the communicating person received through the user's cell phone and applies processing such as amplification to the received sound signal for output of a sound. The sound output assembly 100 converts a voice produced by the user to a sound signal, and transmits to the user's cell phone the sound signal to which the processing such as amplification is applied. The sound signal transmitted from the sound output assembly 100 to the user's cell phone is transmitted to the communicating person's cell phone.

The sound output assembly 100 may be used in the interior of a car, for example. In this case, as shown in FIG. 2, the sound output assembly 100 is mounted to an object 7, such as an interior part of the car. Construction of the elements of the sound output assembly 100 is described below. Hereafter, an exemplary case will be described in which the sound output assembly 100 is installed in the interior of the car. Throughout this specification, "planar view" refers to the view from the z-axis.

Enclosure

The enclosure 1 is constituted of different members, and has a box shape. The enclosure 1 has an inner space S for housing the circuit board 2 and the speaker assembly 3. The enclosure 1 is detachable from the object 7. For example, the enclosure 1 is detachably attached to the object 7 by bonding, fitting or the like. The shape of the enclosure 1 is not limited to that illustrated in the drawings. For example, the enclosure 1 may have a cylindrical shape.

The enclosure 1 includes: a first member 11 that has a square flat shape; a second member 12 that has a square flat shape and is provided apart from the first member 11; a third member 13 that has a square tube shape and is positioned between the first member 11 and the second member 12; and a member 14 that has a square flat shape and is provided on the first member 11. In the enclosure 1, the supporting member 15 and the third member 13 are formed as one body, which will be described later. In this embodiment, the enclosure 1 is formed from the first member 11, the second member 12 and the third member 13, each of which are separate members and are connected to each other by bonding, fitting or the like. However, the enclosure 1 may be formed as a single piece constituting each of these members.

The enclosure 1 has an opening 101. The opening 101 causes a sound output from the speaker assembly 3 to be directed to the outside of the enclosure 1. The opening 101 is provided at the center of the first member 11 and the member 14. The first member 11 and the member 14 are also provided with two openings 102 that direct a voice of the user to the microphones 4. As seen in planar view, the openings 102 are provided in the first member 11 one on either side of the opening 101.

The member 14 is provided on an outer surface of the first member 11 such that it does not block the opening 101 or the openings 102. The member 14 acts to increase union between the enclosure 1 and the object 7. The member 14 is interposed between the object 7 and the first member 11 with close contact therebetween, and the object 7 is attached to the enclosure 1.

Upon attachment of the object 7 to the enclosure 1, the member 14 closely conforms to the shape of the object 7 such that no gap exists between the object 7 and the enclosure 1. As a result, undesirable acoustic variations are inhibited.

Examples of a material that can be used for the member 14 include a rubber, a soft resin, a porous structure (e.g., a closed-cell sponge material and an open-cell sponge), and a jelly-like material. Preferable as use for the member 14 from among these materials is a closed-cell sponge material, due to its high impact resilience. Also use of this, material for the member 14 inhibits undesirable acoustic variations. The closed-cell sponge material is also advantageous over the other example materials in that it is readily available and easy to handle.

A material used for each of the first member 11, the second member 12 and the third member 13 is not limited to a closed-cell sponge material; and examples of materials that can be used include various resins and other similar materials. It is of note that in this embodiment the enclosure 1 is described as including the member 14; however, the enclosure 1 need not necessarily include the member 14.

Circuit Board

The circuit board 2 is adhered to the first member 11 with, for example, adhesive members 201 supplemented with fixing screws 301. The adhesive members 201 may be formed from, for example, double-sided adhesive tape. The circuit board 2 is equipped with integrated circuitry (IC) including signal processing circuitry that amplifies a sound signal and carries out a variety of signal processing. The circuit board 2 is also equipped with various communication modules, such as a module that receives and transmits the sound signal.

Between the circuit board 2 and the first member 11 there are interposed vibration absorbers 51 (second vibration absorbers), which act to absorb vibration. The vibration absorbers 51 are provided at a portion on the first member 11 separate from that at which the adhesive members 201 are provided. As seen from the planar view in the drawings, the vibration absorbers 51 are positioned outward of the adhesive members 201. The provision of the vibration absorbers 51 between the circuit board 2 and the first member 11 effectively reduces transmission of vibration from the circuit board 2 to the enclosure 1. Furthermore, vibration transmitted to the microphones 4 provided on the circuit board 2 through the first member 11 is effectively reduced. The same example material as used for the above-mentioned member 14 may be used for the vibration absorbers 51, or one different to that above-mentioned used for the member 14 may be used. However, from a view point of simplicity of design and cost savings, it is preferable that the vibration absorbers 51 be made of the same material as that of the member 14, and that each be made of the closed-cell sponge material.

The number of the circuit boards 2 and an arrangement thereof are not limited to the examples shown in the drawings, and are freely selectable. The circuit board 2 may be, for example, positioned on the inner side of the second member 12; and more than one of the circuit board 2 may be used.

Microphones

Two microphones 4 are provided on the circuit board 2. The two microphones 4 have a one-to-one correspondence with the two openings 102. The microphones 4 are disposed such that the speaker assembly 3 is positioned between the two microphones 4.

Each of the microphones 4 converts a voice of the user to an electrical sound signal. The thus generated electrical signal is output to the signal processing circuitry on the circuit board 2. Examples of each of the microphones 4 include a Micro-Electrical-Mechanical System (MEMS). The number of the microphones 4 and an arrangement thereof are not limited to the examples shown in the drawings.

Speaker Assembly

The speaker assembly 3 is disposed between the circuit board 2 and the second member 12, and is positioned apart from both the circuit board 2 and the enclosure 1.

The sound signal supplied from the signal processing circuitry on the circuit board 2 is caused by the speaker assembly 3, to vibrate an acoustic diaphragm 311 and generate sound waves, i.e., a sound. The speaker assembly 3 is electrically connected to the circuit board 2 with wires 33. The speaker assembly 3 includes the acoustic diaphragm 311, a driver 312 that causes the acoustic diaphragm 311 to vibrate, and a frame 313 that houses the driver 312. The acoustic diaphragm 311 consists of an acoustic membrane that vibrates in accordance with the sound signal. This speaker assembly 3 is dynamic type. However, the construction of the speaker assembly 3 is not limited thereto. In the dynamic type, the driver 312 is constituted of a permanent magnet and a voice coil, and the acoustic diaphragm 311 is connected to the voice coil. The acoustic diaphragm 311 may be of a plate shape or a cone shape.

The acoustic diaphragm 311 is disposed between the first member 11 and the second member 12 at a position that corresponds to a position of the opening 101. Otherwise stated and more specifically, the opening 101 is provided at a position that corresponds to a position of the acoustic diaphragm 311 such that a sound output from the acoustic diaphragm 311 is directed toward the outside of the enclosure 1.

Supporting Member

As shown in FIG. 2, the supporting member 15 is disposed between the circuit board 2 and the speaker assembly 3. The supporting member 15 is formed integral with the third member 13 of the enclosure 1, and supports the speaker assembly 3. The supporting member 15 also acts to damp vibration of the speaker assembly 3.

Figure 4:
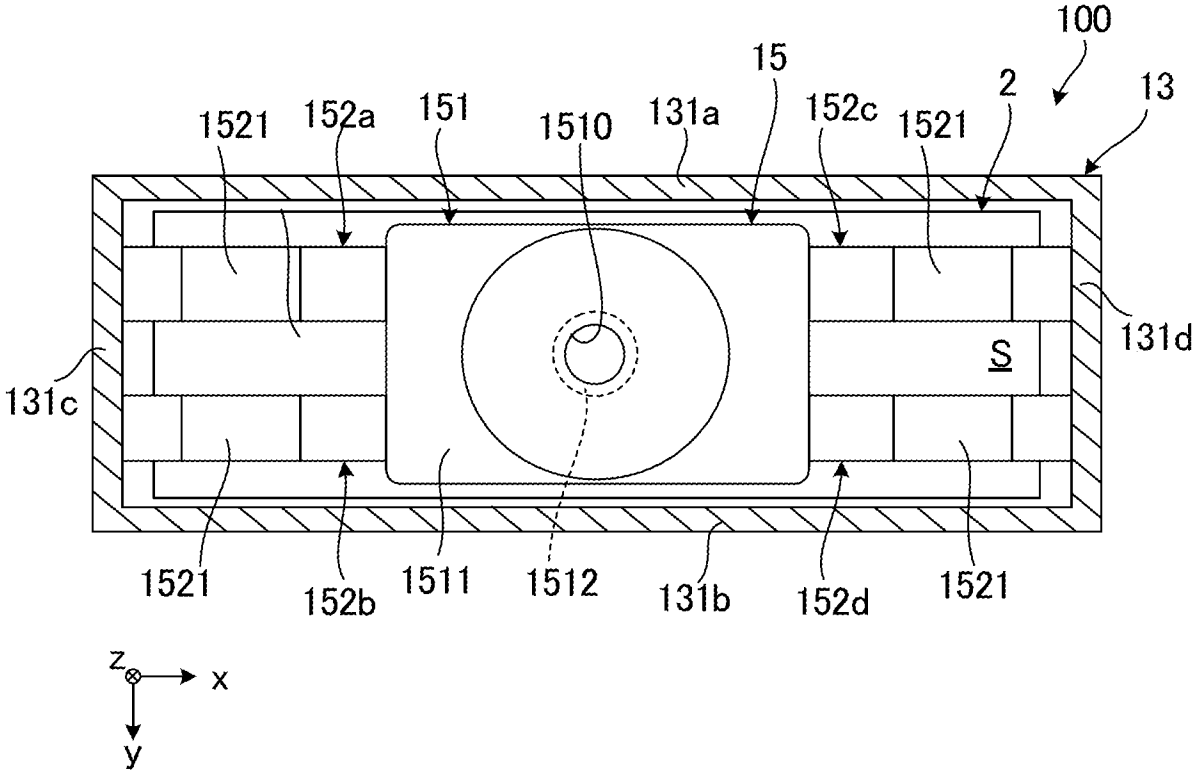
FIG. 4 is a planar view of the supporting member included in the sound output assembly shown in FIG. 1.

FIG. 4 is a planar view of the supporting member included in the sound output assembly shown in FIG. 1. As shown in FIG. 4, the third member 13 has a rectangular shape in planar view. The third member 13 includes side faces 131*a*, 131*b*, 131*c* and 131*b*. The side face 131*a* is provided in opposing relation to the side face b; and the side face 131*c* is provided in opposing relation to the side face d. The side face 131*c* is connected to one end each of the side face 131*a* and the side face 131*b*. The side face 131*d* is connected to the other end each of the side face 131*a* and the side face 131*b*.

The supporting member 15 has a beam shaped structure such that the side face 131*c* and the side face 131*d* of the third member 13 are connected to each other through the supporting member 15. Specifically, as seen from planar view the supporting member 15 includes a main portion 151 having a square shape, and is provided with junctions 152*a* and 152*b*, and junctions 152*c* and 152*d*. As seen in planar view the main portion 151 is positioned at the center of the enclosure 1. Each of the junctions 152*a* and 152*b* is connected to the main portion 151 and the side face 131*c*, and each of the junctions 152*c* and 152*d* is connected to the main portion 151 and the side face 131*d*. In the following description, unless the junctions 152*a*, 152*b*, 152*c* and 152*d* are required to be distinguished from each other, they shall be simply be referred to as "junctions 152."

Main Portion

The main portion 151 has a square shape, and is provided with an opening 1510. As shown in FIGS. 2 and 4, a shape of the opening 1510, which is formed at the center of the main portion 151, is dependent on each of a position, a size and a shape of the acoustic diaphragm 311. The main portion 151 includes a first portion 1511 on which the speaker assembly 3 is disposed, and a second portion 1512 that is connected to the member 14. The first portion 1511 protrudes from the surface of the main portion 151 to a greater extent than the second portion 1512 toward the speaker assembly 3. The second portion 1512 extends from the edge of the main portion 151 in a direction from the main portion 151 to the member 14. The second portion 1512 defines the opening 1510 provided in the main portion 151.

In the main portion 151, the first portion 1511 has a surface 1511*a* for placement of the speaker assembly 3. The surface 1511*a* is adhered to the speaker assembly 3. The second portion 1512 has a surface 1512*a* to which the member 14 is adhered. The surface 1512*a* is adhered to the member 14.

The main portion 151 described above constitutes a part (referred to as a "sealing part") that seals a gap between the speaker assembly 3 and the first member 11. In other words, the supporting member 15 includes the sealing part for sealing the gap between the speaker assembly 3 and the peripheral edge 103 of the opening 101. The sealing part enables omission of a member such as a gasket for sealing the gap between the peripheral edge 103 and the speaker assembly 3. Accordingly, a number of parts of the sound output assembly 100 can be reduced.

The first portion 1511 may be of any shape as long as the speaker assembly 3 can be placed thereon. As shown in FIG. 2, the first portion 1511 need not extend outward toward the speaker assembly 3.

Junctions

As shown in FIG. 2, each of the four junctions 152 (152*a*, 152*b*, 152*c* and 152*d*) has a shape that is defined by multiple bends of a long plate-shaped member along its longitudinal direction. Each of the four junctions 152 includes a bent portion 1521. The bent portion 1521 has a squared U-shape, the bottom surface of which faces the second member 12, and is positioned at the midpoint thereof in the longitudinal direction. As shown in FIG. 4, each of the junctions 152*a* and 152*b* is connected to the main portion 151 and the side face 131*c*. The junctions 152*a* and 152*b* are separate from each other, and are substantially parallel to each other. Each of the junctions 152*c* and 152*d* is connected to the main portion 151 and the side face 131*d*. The junctions 152*c* and 152*d* are separate from each other, and are substantially parallel to each other. The junctions 152*a* and 152*c* are disposed on either side of the main portion 151, and the junctions 152*b* and 152*d* are disposed on either side of the main portion 151.

As mentioned above, each of the four junctions 152 are formed from a plate-shaped member. This relatively simple construction enables damping of vibration transmitted from the speaker assembly 3 to the circuit board 2 and from the circuit board 2 to the enclosure 1. Furthermore, since the junctions 152 are thin they readily deform elastically. Elastic deformation of the junctions 152 enables vibration of the speaker assembly 3 to be effectively damped. As described above, since the four junctions 152 are included within the bent portion 1521, thus, the vibration of the speaker assembly 3 is damped more effectively. It is of note that the number of the bent portions 1521 for one junction 152 is not limited to one; and each of the junctions 152 may have a bellows shape, which further improves damping of the speaker assembly 3. However, from a view point of ease of fabrication and a number of parts used it is preferable that a number of bent portions 1521 for one junction 142 be kept to one, as shown in the drawings. The bent portion 1521 may have a squared U-shape, the bottom surface of which faces the first member 11.

In the sound output assembly 100, the mass of the speaker assembly 3 in conjunction with a compliance of the supporting member 15 and a compliance of air present within the inner space S of the enclosure 1 acts as a low-pass filter. An input to the low-pass filter corresponds to a force for driving the acoustic diaphragm 311, and an output from the low pass-filter corresponds to a force for driving the circuit board 2. Thus, it is preferable that the thickness of the supporting member 15, the shape thereof, the material used to form the same and other relevant factors be determined with a view to creation of a viable low-pass filter as construed in the preceding description.

In this way vibration transmitted to the circuit board 2 and the enclosure 1 can be damped. As a result, it is possible to reduce vibrational noise of the object 7 resulting from transmission of vibration from the enclosure 1 to the object 7.

A vibration absorber 52 (a first vibration absorber) is interposed between the speaker assembly 3 and the second member 12 of the enclosure 1. As seen in planar view, the vibration absorber 52 is positioned at the center of the speaker assembly 3. This construction enables the main part 31 to remain stable within the enclosure 1, as compared to a case in which the vibration absorber 52 is not provided. Furthermore, this construction enables vibration transmitted to the enclosure 1 to be effectively absorbed. As a result, it is possible to reduce vibrational noise of the object 7 caused by transmission of vibration from the speaker assembly 3 to the object 7 through the enclosure 1.

The same exemplary material employed in the above-mentioned member 14 can also be used for the vibration absorber 52. The vibration absorber 52 may be made of the same material as the member 14 and the vibration absorbers 51, or each may be made of a different material. In the drawings, the vibration absorber 52 is shown only at a single space between the speaker assembly 3 and the enclosure 1. However, the vibration absorber 52 may be provided along the entire length therebetween.

As explained in the foregoing, the sound output assembly 100 includes the enclosure 1, the speaker assembly 3 disposed inside the enclosure, and the supporting member 15 that is formed integral with the enclosure. The speaker assembly 3 includes an acoustic diaphragm 311 configured to output a sound by vibrating in accordance with an electrical sound signal. The supporting member 15 is configured to support the speaker assembly 3 and damp vibration of the speaker assembly 3.

Since the sound output assembly 100 includes the supporting member 15 described above, vibration of the speaker assembly 3 is damped. Thus vibration transmitted via the supporting member 15 to the enclosure 1 is damped. Consequently, it is possible to reduce vibrational noise of the object 7 that results from transmission of vibration from the speaker assembly 3 to the object 7. Since the enclosure 1 and the supporting member 15 are formed as one body, vibration of the speaker assembly 3 is more effectively damped, as compared to a case in which they are provided separate from each other. Furthermore, the provision of the supporting member 15 enables vibration transmitted from the speaker assembly 3 to the object 7 to be damped. As a result, vibration of the microphones 4, which is caused by transmission of vibration from the speaker assembly 3 to the microphones 4 via the enclosure 1, is damped. Consequently, vibrational noise of the microphones 4 is also reduced. The reduction of vibrational noise provides an improvement in the sound of the sound output assembly 100. Since the supporting member 15 and the enclosure 1 are formed as one body, a number of parts and costs are reduced.

In the embodiment, the supporting member 15 is formed integral with the third member 13. Alternatively, the supporting member 15 may be formed integral with the first member 11 or the second member 12.

As described above, the supporting member 15 has a beam shape, which provides stable support for the speaker assembly 3. Furthermore, since the supporting member 15 has a beam shape, it can be readily formed to have elasticity, thereby enabling ease of manufacture of the same. The shape of the supporting member 15 is not limited to the beam shape, and may be of a mesh shape, for example.

As described in the foregoing, since the low-pass filter is formed by the mass of the speaker assembly 3 in conjunction with the supporting member 15 and the air present inside the inner space S of the enclosure 1, the amount of vibration transmitted to the enclosure 1 is reduced. Accordingly, it is possible to reduce vibrational noise of the object 7 that results from transmission of vibration from the enclosure 1 to the object 7. The reduction in vibrational noise provides an improvement in the sound quality of the sound output assembly 100.

As described in the foregoing, the sound output assembly 100 includes, in addition to the supporting member 15, the vibration absorber 52. The combination of the supporting member 15 having elastic properties and the vibration absorber 52 having vibration absorbing properties imparts a synergistic effect, whereby the object 7 produces significantly less vibrational noise that results from transmission of vibration. Furthermore, as described in the foregoing, the sound output assembly 100 includes the member 14. The member 14 is connected to the supporting member 15. Accordingly, the member 14 acts to absorb vibration of the supporting member 15 that supports the speaker assembly 3. The provision of the member 14 in addition to the supporting member 15 enables effective reduction in vibrational noise of the object 7. A material used for vibration absorber 52, and that used for the member 14, along with a shape of the supporting member 15 can be preferentially selected for efficient suppression of noise generated by the vibration of the object 7.

The foregoing sound output assembly 100 is also able to output ¥a musical sound or other similar sounds.

Second Embodiment

Figure 5:
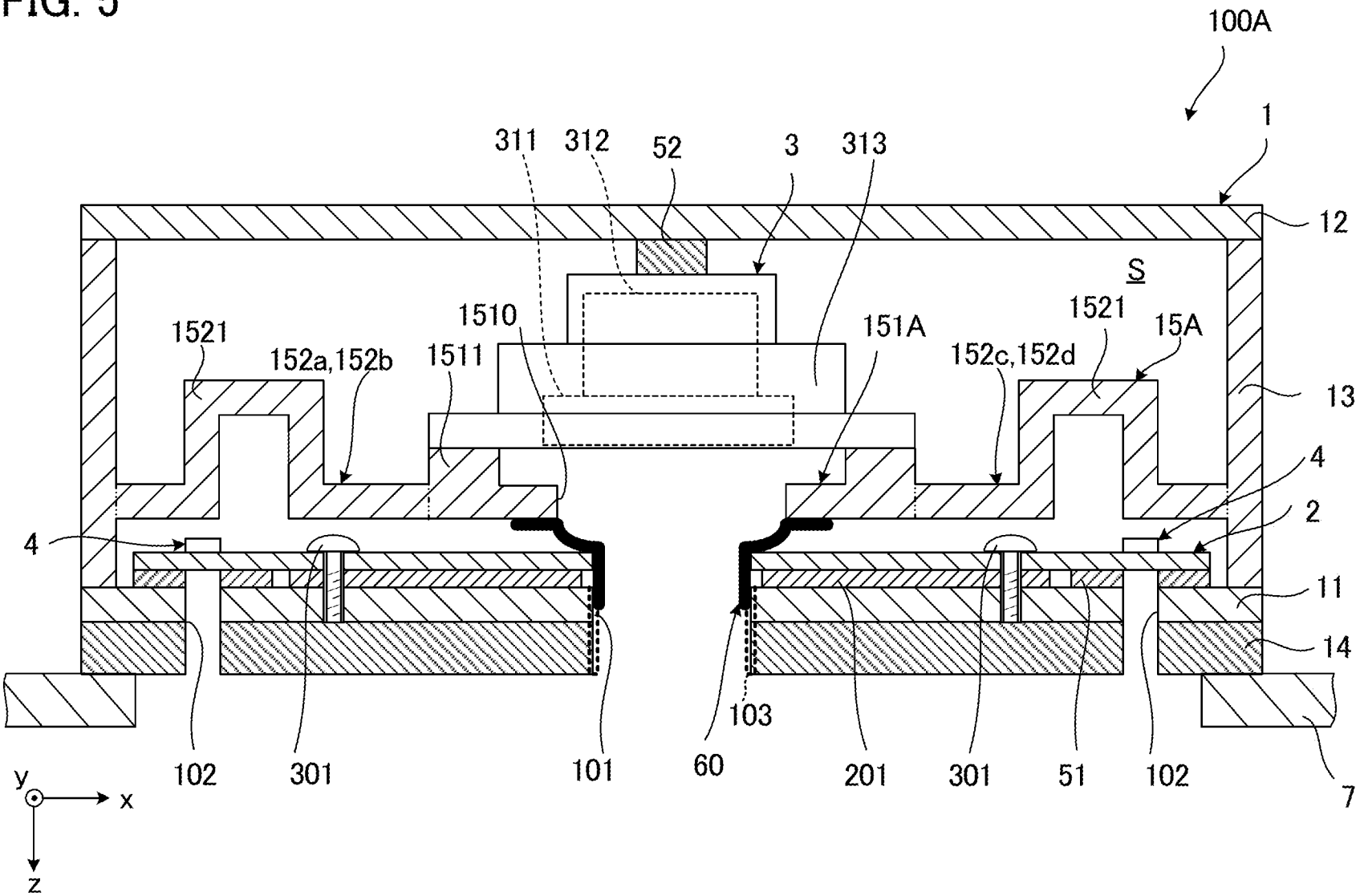
FIG. 5 is a cross-sectional view of a sound output assembly according to a second embodiment.
Figure 6:
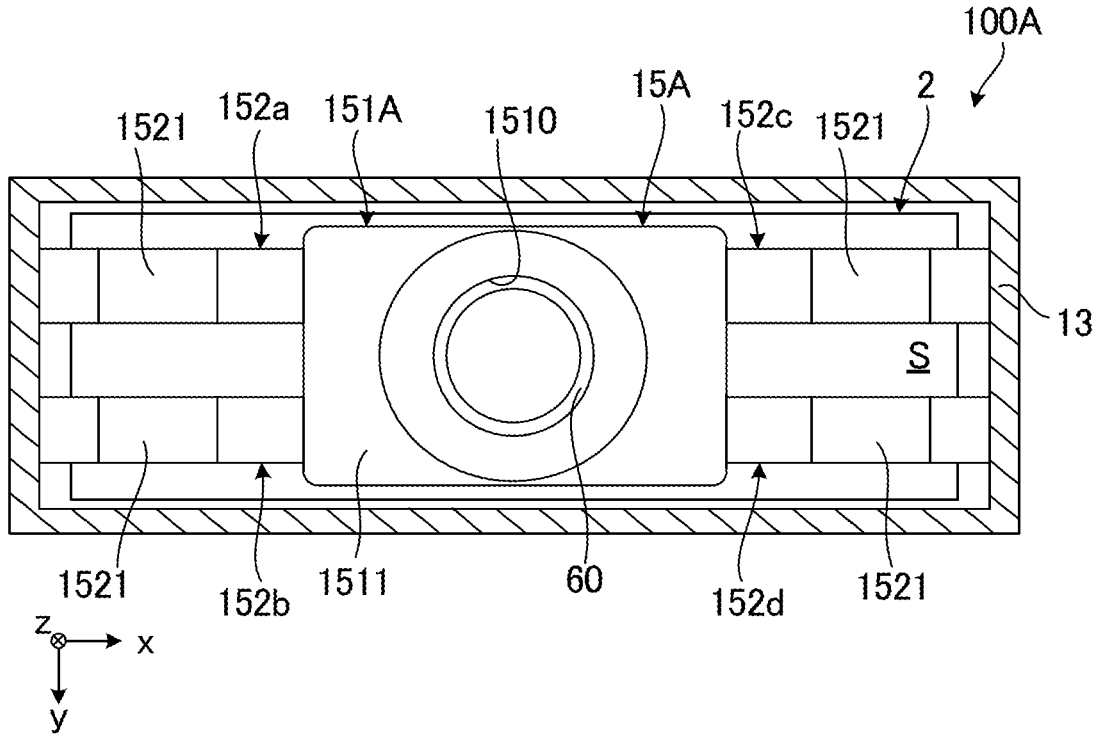
FIG. 6 is a planar view of a supporting member included in the sound output assembly shown in FIG. 5.

Next, the second embodiment according to the present disclosure now will be described. FIG. 5 is a cross-sectional view of a sound output assembly according to the second embodiment. FIG. 6 is a planar view of a supporting member included in the sound output assembly shown in FIG. 5.

The sound output assembly according to the second embodiment is substantially the same as that in the first embodiment, with the exceptions that (A) a support member of a different structure to that of the first embodiment are provided and (B) a gasket.

The following description of the second embodiment mainly focuses on these points of difference comparative to the first embodiment; aside from these points of difference matters common to the first embodiment are described. In FIGS. 5 and 6 illustrating the second embodiment, the same components depicted in the first embodiment are denoted by the same reference signs.

The sound output assembly 100A shown in FIGS. 5 and 6 includes a supporting member 15A. The supporting member 15A does not include the second portion 1512 of the supporting member 15 according to the first embodiment. Thus, the supporting member 15A includes a main portion 151A with the opening 1510 that extends in the direction of thickness through the enclosure 1 (the first member 11 and the member 14) and the first portion 1511 on which the speaker assembly 3 is positioned.

A sealing member 60 is disposed between the main portion 151A and the first member 11 of the enclosure 1. The sealing member 60 is constructed from a ring-shaped gasket, for example. The sealing member 60 is adhered to both the main portion 151A and the first member 11.

In the second embodiment, the enclosure 1 is provided with the opening 101 at a position that corresponds to the acoustic diaphragm 311, the same as in the first embodiment. As described above, the sound output assembly 100A includes the sealing member 60. The sealing member 60 is formed separate from the supporting member 15A, is connected to the supporting member 15A and seals a gap between the peripheral edge 103 and the speaker assembly 3 along with a portion of the supporting member 15A. That is, the sound output assembly 100A includes the sealing member 60, a main purpose of which is to seal the gap between the speaker assembly 3 and the enclosure 1; a main purpose of the supporting member 15A is to support the speaker assembly 3. Provision of the sealing member 60 enhances airtightness of the inner space S of the enclosure 1 as compared to the first embodiment. Thus, the sound output assembly 100A is less susceptible to vibrational noise generated outside the enclosure 1, and the speaker assembly 3 likewise is less susceptible to vibrational noise. Furthermore, since the supporting member 15A does not include the second portion 1512 in contrast to the supporting member 15 according to the first embodiment, the structure of the supporting member 15A is simplified. As a result design of the sound output assembly 100A is facilitated and costs can be reduced.

As stated in the foregoing, the configuration according to the second embodiment enables a reduction in vibrational noise, and a number of parts used.

Third Embodiment

Figure 7:
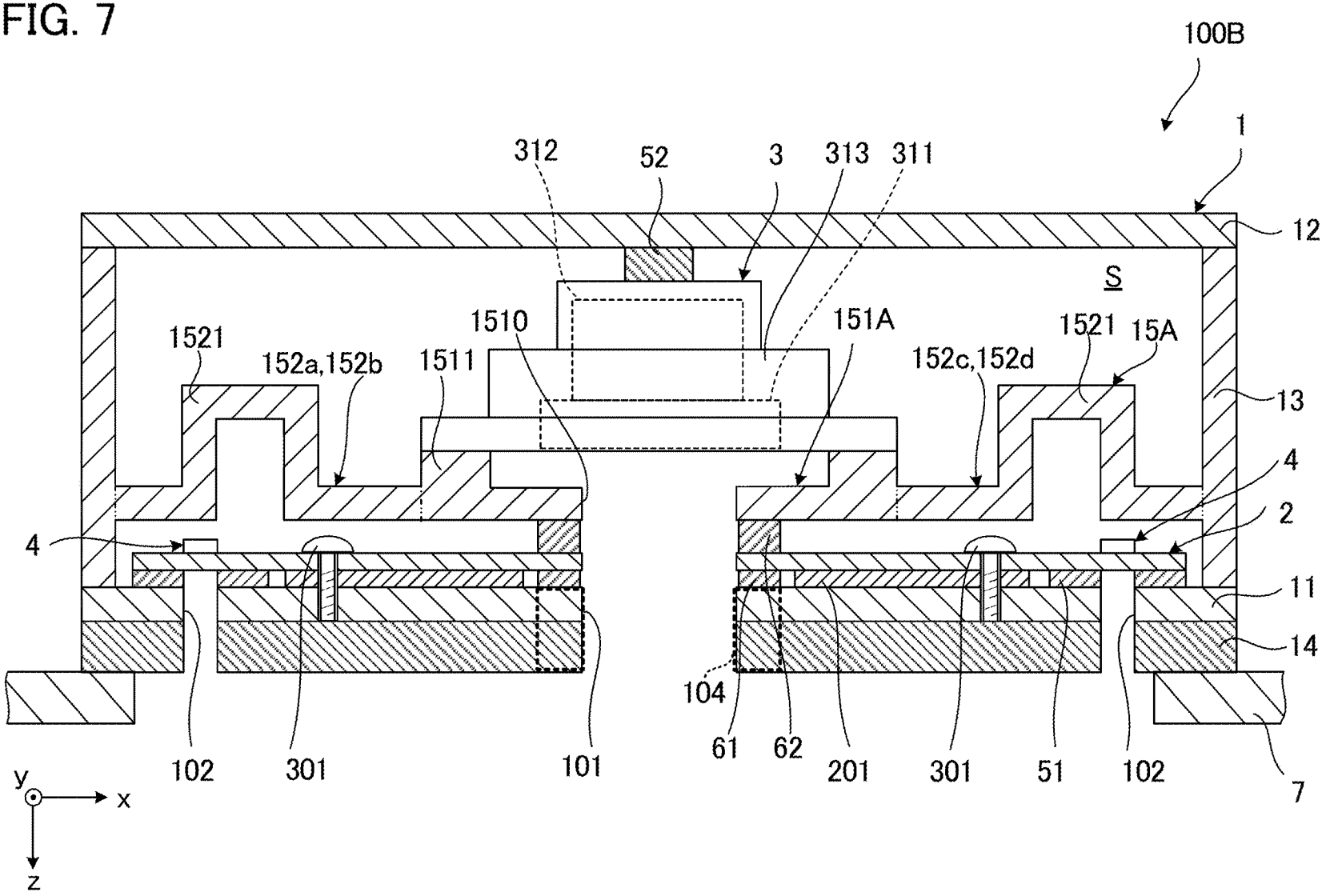
FIG. 7 is a cross-sectional view of a sound output assembly according to a third embodiment.

Next, the third embodiment according to the present disclosure will be described. FIG. 7 is a cross-sectional view of a sound output assembly according to the third embodiment.

The sound output assembly according to the third embodiment is basically the same as that of the second embodiment, with the exception that a support assistance member is employed instead of the gasket.

The following description of the third embodiment focuses on the main point of difference from the second embodiment, and description of matters that are common to the second embodiment is omitted. In FIG. 7, the same components in the second embodiment are denoted by the same reference signs.

A sound output assembly 100B shown in FIG. 7 includes support assistance members 61 and 62 that are disposed between the supporting member 15A and the first member 11 of the enclosure 1. The support assistance members 61 and 62 assist the supporting member 15A that support the speaker assembly 3.

The support assistance member 61 is positioned between the first member and the circuit board 2, and is adhered to each. The support assistance member 62 is positioned between the circuit board 2 and the main portion 151A, and is adhered to each.

The same exemplary material used for the member 14 can also be used for the support assistance members 61 and 62, and it is preferable that the support assistance members 61 and 62 be made of a closed-cell sponge material. The use of the closed-cell sponge material for the support assistance members 61 and 62 assists in support of the speaker assembly 3 and enables effective reduction of vibration transmitted to the enclosure 1.

As described above, the sound output assembly 100B includes the support assistance members 61 and 62. The enclosure 1 includes the opening 101 provided at a position that corresponds to the acoustic diaphragm 311. The support assistance members 61 and 62 are formed separate from the supporting member 15A, and are disposed between the periphery edge 103 and the supporting member 15A. This provides the following advantages. This provides the following advantages. The support assistance members 61 and 62 act to absorb vibration transmitted from the speaker assembly 3 to the supporting member 15A. Accordingly, transmission of vibration to the circuit board 2 and the enclosure 1 is reduced. Furthermore, the support assistance members 61 and 62 provides stable support for the speaker assembly 3 and a simple construction for the supporting member 15A as compared to the supporting member 15 according to the first embodiment. As a result, costs can be effectively restrained. Since the provision of the supporting member 15A and the support assistance members 61 and 62 facilitate easy assembly of the sound output assembly, a high yield ratio can be achieved. Furthermore, the support assistance member 61 is adhered to the first member 11 and the circuit board 2, and the support assistance member 62 is adhered to the main portion 151A and the circuit board 2. Accordingly, the provision of the supporting member 15A, the support assistance members 61 and 62, and the circuit board 2 enable the gap between the speaker assembly 3 and the enclosure 1 to be sealed. As a result, the sound output assembly 100B is less likely to be affected by vibrational noise generated inside the enclosure 1, and thus less noise vibrational noise affects the speaker assembly 3.

As explained in the foregoing, the configuration according to the third embodiment reduces vibrational noise and a number of parts used.

Although the sound output assemblies according to the present disclosure are explained based on the embodiment shown in the drawings, the present disclosure is not limited thereto. Components according to the present disclosure may be replaced with other freely selected components that have the same function as those described in the embodiments, and different selected components may be freely combined. In the present disclosure, freely selected components in each of the foregoing embodiments may be combined with one another.

In the foregoing embodiments, an exemplary case is described in which each of the sound output assemblies includes microphones. However, the present disclosure need not include microphones.

In the foregoing embodiments, an exemplary case is described in which the sound output assemblies are employed in vehicles such as cars. However, the sound output assembly may be employed other than in vehicles such as cars. For example, the sound output assembly may be mounted to an inner wall of a building.

In the foregoing embodiments, the circuit board is disposed in the enclosure. However, the circuit board may be disposed outside the enclosure.

The following aspects of the present disclosure are derivable from the embodiments exemplified above.

A sound output assembly according to a preferred aspect of the present disclosure includes: an enclosure; a speaker assembly disposed inside the enclosure, and a supporting member having at least a first end fixed to the enclosure such that the at least the first end of the supporting member and the enclosure are formed as one body, in which: the speaker assembly includes an acoustic diaphragm configured to produce a sound by vibrating in accordance with a sound signal, and the supporting member is configured to support the speaker assembly and to dampen vibration of the speaker assembly. According to this aspect, the provision of the supporting member described above enables vibration of the speaker assembly to be damped. This results in damping of vibration that travels to the enclosure through the supporting member. As a result, even when the sound output assembly is attached to an object, it is possible to reduce noise generated by vibration of the object resulting from vibration transmitted from the speaker assembly to the object. Furthermore, since the supporting member is formed integral with the enclosure, this aspect enables the number of parts used and costs incurred to be reduced.

In the preferred aspect of the sound output assembly described above, the supporting member is beam shaped.

This aspect provides stable support for the speaker assembly. Furthermore, a supporting member that has high elasticity can be easily formed.

In the preferred aspect of the sound output assembly described above, the enclosure has an opening disposed at a position that corresponds to the acoustic diaphragm, and the supporting member includes a part that seals a gap between a peripheral edge of the opening and the speaker assembly.

This aspect enables omission of a gasket for sealing the gap between the peripheral edge and the speaker assembly. Accordingly, a number of parts used for the sound output assembly is reduced.

In the preferred aspect of the sound output assembly described above, the sound output assembly further includes a sealing member connected to the supporting member, in which: the enclosure has an opening disposed at a position that corresponds to the acoustic diaphragm, and the sealing member and a portion of the supporting member together seal a gap between a peripheral edge of the opening and the speaker assembly.

According to this aspect, the sound output assembly includes the supporting member that supports the speaker assembly, and the sealing member that seals the enclosure. This configuration enhances airtightness of the inner space of the enclosure. Accordingly, the sound output assembly is less likely to be affected to vibrational noise generated outside the enclosure, as compared to a sound output assembly that does not include the sealing member, and thus reduces vibrational noise that affects the speaker assembly. As compared to the supporting member with the sealing part described above, the structure according to this aspect can be simplified. Therefore, by this aspect design is facilitated, and costs are restrained.

In the preferred aspect of the sound output assembly described above, the sound output assembly further includes a support assistance member configured to absorb vibration being transmitted from the speaker assembly to the enclosure and to assist supporting the speaker assembly, in which: the enclosure has an opening disposed at a position that corresponds to the acoustic diaphragm, and the support assistance member is formed separate from the supporting member, and is disposed between a peripheral edge of the opening and the supporting member.

This aspect enables vibration transmitted from the speaker portion to the supporting member to be absorbed, and provides stable support for the speaker assembly.

In the preferred aspect of the sound output assembly described above, the sound output assembly further includes a vibration absorber configured to absorb vibration being transmitted from the speaker assembly to the enclosure, in which: the enclosure includes: a first member having an opening disposed at a position that corresponds to the acoustic diaphragm; and a second member disposed apart from the first member, in which the speaker assembly is disposed between the first member of the enclosure and the second member of the enclosure, and in which the vibration absorber is disposed between the second member of the enclosure and the speaker assembly.

This aspect enables the speaker assembly to remain steady within the enclosure as compared to a sound output assembly that does not include the vibration absorber. This aspect also enables absorption of the vibration transmitted from the speaker assembly to the enclosure. As a result, it is possible to reduce vibrational noise generated by the vibration of the part.

In the preferred aspect of the sound output assembly described above, the at least the first end of the supporting member and the enclosure are formed as one body by the at least the first end of the supporting member being welded to the enclosure.

In the preferred aspect of the sound output assembly described above, the at least the first end of the supporting member and the enclosure are formed as one body by the at least the first end of the supporting member being integrally formed with the enclosure.

DESCRIPTION OF REFERENCE SIGNS

1 . . . enclosure, 3 . . . speaker assembly, 7 . . . object, 15 and 15A . . . supporting member, 52 . . . vibration absorber (a first vibration absorber), 100 and 100A . . . sound output assembly, 311 . . . acoustic diaphragm, 60 . . . sealing member, 61 and 62 . . . support assistance member

What is claimed is:

1. A sound output assembly comprising:

an enclosure configured to be detachably mountable to an automobile;

a speaker assembly disposed inside the enclosure;

a supporting member having at least a first end fixed to the enclosure such that the at least the first end of the supporting member and the enclosure are formed as one body; and a sealing member connected to the supporting member, wherein:

the speaker assembly includes an acoustic diaphragm configured to produce a sound by vibrating in accordance with a sound signal, the supporting member has a beam structure, includes at least one bent portion, and is configured to support the speaker assembly and to dampen vibration of the speaker assembly, the enclosure has an opening disposed at a position that corresponds to the acoustic diaphragm, and the sealing member and a portion of the supporting member together seal a gap between a peripheral edge of the opening and the speaker assembly.

2. The sound output assembly according to claim 1, further comprising a vibration absorber configured to absorb vibration being transmitted from the speaker assembly to the enclosure, wherein the enclosure includes:

a first member having the opening disposed at the position that corresponds to the acoustic diaphragm; and a second member disposed apart from the first member, wherein the speaker assembly is disposed between the first member of the enclosure and the second member of the enclosure, and wherein the vibration absorber is disposed between the second member of the enclosure and the speaker assembly.

3. The sound output assembly according to claim 1, wherein the at least the first end of the supporting member and the enclosure are formed as one body by the at least the first end of the supporting member being welded to the enclosure.

4. The sound output assembly according to claim 1, wherein the at least the first end of the supporting member and the enclosure are formed as one body by the at least the first end of the supporting member being integrally formed with the enclosure.

5. The sound output assembly according to claim 1, wherein the at least one bent portion has a squared U-shape.

6. A sound output assembly comprising:

an enclosure;

a speaker assembly disposed inside the enclosure; and a supporting member having a main portion, a first junction connected to the main portion and to a first side face of the enclosure, and a second junction connected to the main portion and to a second side face of the enclosure different from the first side face of the enclosure, wherein:

the speaker assembly includes an acoustic diaphragm configured to produce a sound by vibrating in accordance with a sound signal, the supporting member is configured to support the speaker assembly by the main portion of the supporting member and to dampen vibration of the speaker assembly by elastic deformation of the first junction and the second junction, and the first junction includes a first bent portion, and the second junction includes a second bent portion.

7. The sound output assembly according to claim 6, wherein the first bent portion has a squared U-shape, and the second bent portion has a squared U-shape.

8. The sound output assembly according to claim 6, wherein the first side face of the enclosure and the second side face of the enclosure are disposed on opposite sides of the enclosure from each other.

9. The sound output assembly according to claim 6, wherein the supporting member further includes (i) a third junction separated from the first junction and connected to the main portion and to the first side face of the enclosure and (ii) a fourth junction separated from the second junction and connected to the main portion and to the second side face of the enclosure.

10. The sound output assembly according to claim 9, wherein the third junction includes a third bent portion, and the fourth junction includes a fourth bent portion.

11. A sound output assembly comprising:

an enclosure;

a speaker assembly disposed inside the enclosure; and a supporting member having a main portion, a first junction connected to the main portion and to a first side face of the enclosure, and a second junction connected to the main portion and to a second side face of the enclosure different from the first side face of the enclosure, wherein:

the speaker assembly includes an acoustic diaphragm configured to produce a sound by vibrating in accordance with a sound signal, the supporting member is configured to support the speaker assembly by the main portion of the supporting member and to dampen vibration of the speaker assembly by elastic deformation of the first junction and the second junction, the supporting member further includes (i) a third junction separated from the first junction and connected to the main portion and to the first side face of the enclosure and (ii) a fourth junction separated from the second junction and connected to the main portion and to the second side face of the enclosure, and wherein the first junction and the third junction are substantially parallel to each other, and the second junction and the fourth junction are substantially parallel to each other.

* * * * *